US006416400B1

(12) United States Patent
Schlatter et al.

(10) Patent No.: US 6,416,400 B1
(45) Date of Patent: Jul. 9, 2002

(54) APPARATUS FOR REDUCING THE ROUGHNESS AND ABRASIVE SHEDDING OF COATING TAPES

(75) Inventors: Manfred Schlatter, Freiburg; Manfred Schultheiss, Kehl, both of (DE)

(73) Assignee: EMTEC Magnetics GmbH, Ludwigshafen (DE)

( * ) Notice: Subject to any disclaimer, the term of this patent is extended or adjusted under 35 U.S.C. 154(b) by 0 days.

(21) Appl. No.: 09/002,834

(22) Filed: Jan. 5, 1998

(30) Foreign Application Priority Data

Jan. 13, 1997 (DE) ..... 297 00 458 U

(51) Int. Cl.[7] ..... B24B 1/00

(52) U.S. Cl. ..... 451/53; 451/28; 451/541; 451/544; 451/546; 451/547

(58) Field of Search ..... 451/541, 544, 451/546, 547, 28, 36, 53

(56) References Cited

U.S. PATENT DOCUMENTS

| | | | | |
|---|---|---|---|---|
| 3,132,815 A | * | 5/1964 | Wagner | 451/547 |
| 3,468,583 A | * | 9/1969 | Austin | 451/547 |
| 3,510,990 A | * | 5/1970 | Steindler | 451/541 |
| 3,629,918 A | | 12/1971 | Hart | 29/78 |
| 3,715,787 A | | 2/1973 | Hudson | 29/76 |
| 4,187,754 A | * | 2/1980 | Beaty | 451/541 |
| 4,208,843 A | * | 6/1980 | Amaki et al. | 451/541 |
| 4,637,370 A | * | 1/1987 | Ishizuka | 451/541 |

FOREIGN PATENT DOCUMENTS

| | | |
|---|---|---|
| DE | 3332085 | 9/1983 |
| FR | 492132 | 10/1918 |
| GB | 445512 | 4/1936 |
| GB | 2092474 | 8/1982 |

* cited by examiner

*Primary Examiner*—Eileen P. Morgan
(74) *Attorney, Agent, or Firm*—Keil & Weinkauf

(57) ABSTRACT

A polishing apparatus for reducing the roughness and abrasive shedding of coated tapes comprises a cylinder having coaxial channels or grooves of various forms, which are advantageously thread-like. Axial grooves may be additionally provided.

20 Claims, 2 Drawing Sheets

APPARATUS FOR REDUCING THE ROUGHNESS AND ABRASIVE SHEDDING OF COATING TAPES

BACKGROUND OF THE INVENTION

1. Field of the Invention

The invention relates to an apparatus for reducing the roughness and abrasive shedding of coated tapes by means of a rotating polishing element having a structured circumferential surface.

Coated tapes of the type which are "rough" and cause abrasive shedding have a coating with a binder which comprises, for example, a polymer softer than PVC.

If such coated tapes are operated in equipment sensitive to abrasively shed material in such a way that these tapes come into contact with surfaces of fixed or moving parts of the equipment, malfunctions may occur as a result of deposition or accumulation of the abrasively shed material.

2. Description of the Related Art

A number of apparatuses and/or methods are known in which the surface of flexible tape-like material webs, for example of magnetic recording media are treated.

U.S. Pat. No. 5,012,548 discloses an apparatus for cleaning magnetic tapes having a rotatable cleaning element with hard, sharpedged inserts embedded in the circumference of a softer structure and airflow openings which are connected to a vacuum source. The tape is brought into contact to the blades and the cleaning element is rotated at a speed so that the tape passing over the cleaning element slips relative to the element.

U.S. Pat. No. 5,658,618 describes a further method of surface treatment. The essential feature of this method is that the abrasive coated surface of the material web is treated with itself, i.e. once again with a coated abrasive surface, by passing the web in the apparatus in such a way that, under predetermined conditions, the surfaces touch one another or come into frictional contact with one another over a certain length. The web movement is in opposite directions in the contact zone so that the resulting speed of the two surfaces relative to one another is twice the web speed. The treatment takes place simultaneously on the two surfaces: first, the surface which has been unwound last and is still untreated comes into contact with a previously treated surface which then itself becomes the surface treated once and, after deflection, comes into contact with a new surface not yet treated. Each of the two surfaces thus treats the other, actually resulting in a marked reduction in the abrasiveness. The dust formed in the frictional treatment must be extracted by a cleaning unit.

SUMMARY OF THE INVENTION

It is consequently an object of the present invention to remove such abrasively shed material from coated tapes which are intended for use in equipment of the type described without having dust-like residues to be removed by additional cleaning means.

We have found that this object is achieved according to the invention with an apparatus for reducing the roughness and abrasive shedding of coated tapes by means of a rotating polishing element having a structured circumferential surface, by means of a thread-like structure provided on the circumference of the polishing element.

Consequently, when the coating surface is taken past the circumferential structure mentioned, its roughness is reduced by grinding away the the peaks of the surface roughness and, surprisingly, at the same time the abrasively shed material is removed from the surface, which was not possible to achieve by cleaning alone.

In a partical refinement, the polishing element is a cylinder of which the height corresponds at least to the width of the coated tape, and in particular is twice the width.

This ensures simple production of the polishing element and provides an adequate contact surface for the coated tape.

The circumferential structure of the cylinder may expediently substantially comprise coaxially arranged grooves, which may also have thread-like forms and may also be arranged with a minimum pitch of 0.16 mm.

To increase the effectiveness of the polishing element, there are advantageously also axially arranged grooves on the cylinder circumference.

The axial grooves may be formed with a V form, which encloses in particular an angle of 112°, but they may also have a sawtooth form, which may enclose in particular an angle of 63°.

The number of coaxial grooves may lie between about 1 and 20 and should be about 10 to achieve optimum results.

The coaxial grooves may have substantially a V form and the ridges in between may have a flank width of 0.1 mm at the circumferential surface of the cylinder.

The material of the cylinder circumference expediently comprises hardened steel. However, it may also advantageously comprise oxide ceramic or hard metal alloy.

The material of the cylinder circumference should have a hardness of at least 60 Rockwell.

BRIEF DESCRIPTION OF THE DRAWINGS

FIG. 1AX is an exploded view of the circumferential surface of the polishing element of FIG. 1A.

FIG. 1BY is an exploded view of the circumferential surface of the polishing element of FIG. 1B.

FIGS. 2BY1 and 2BY2 show exploded views of the circumferential surface of the polishing element of FIG. 2B.

DESCRIPTION OF THE PREFERRED EMBODIMENT(S)

Figure 1A:
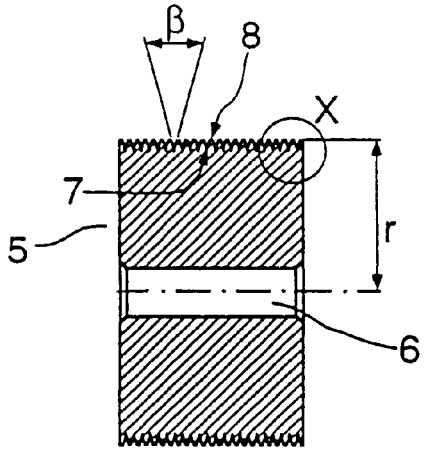
FIGS. 1A and 1B show a polishing cylinder of relatively small diameter, having coaxial or thread-like grooves and axial grooves.

A polishing element is represented in FIGS. 1A/1B and 2A/2B as a polishing cylinder 5 and 5A, respectively, having a central bore 6 and 6A, respectively, for receiving a spindle (not shown) of a rotating element.

Provided on the circumference 7 of the polishing cylinder 5, 5A are either coaxial grooves 8 of annular form or else coaxial grooves arranged helically in a thread-like manner. The cylinder 5 has the diameter 2r, the cylinder 5A has the diameter 2R up to the outer circumferential surface, in which the tips of the ridges 9 between the grooves 8 also lie. The grooves 8 are made, for example, in a known way by turning or grinding, on the cylinder circumfrence 7. As shown enlarged in FIG. 1AX, the grooves 8 may have a V form, for example with an angle β of about 40°. However, other forms of the groove can also be used. After producing the grooves 8, the peaks of the ridges 9 are ground away by suitable grinding devices, so that they still have a defined "flank width" of about 0.1 mm and consequently also have two polishing edges, instead of previously only one.

Figure 1B:
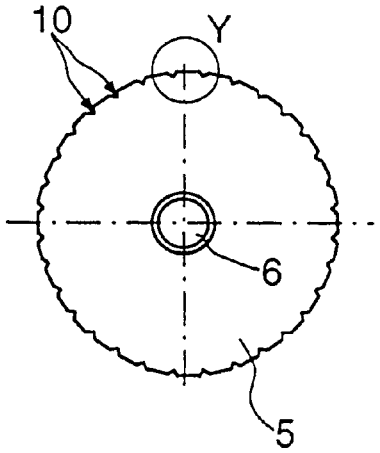
Figure 1A:
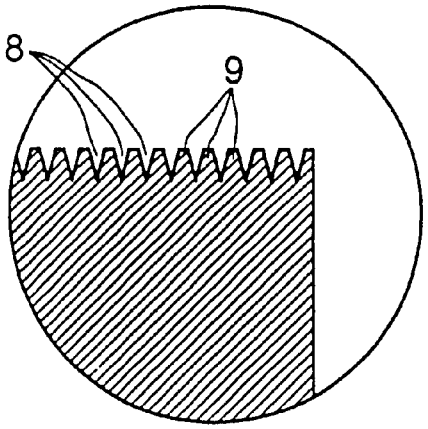
Figure 1B:
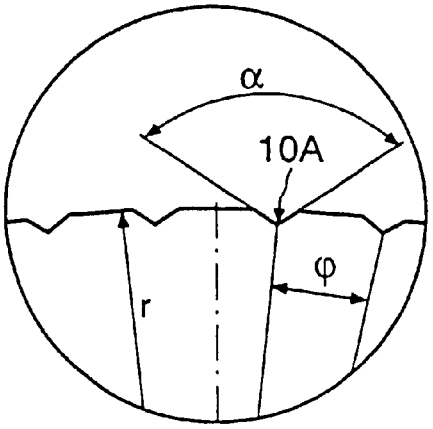
Figure 2A:
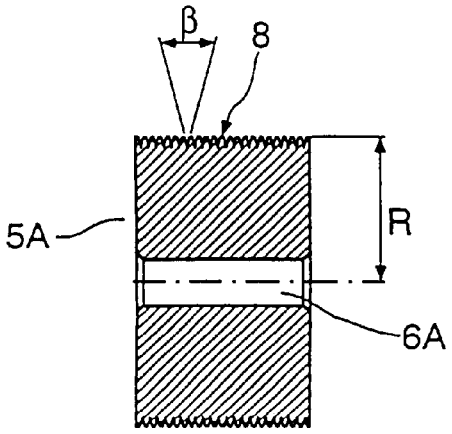
FIGS. 2A and 2B show a polishing cylinder of relatively large diameter, having coaxial or thread-like grooves and axial grooves.
Figure 2B:
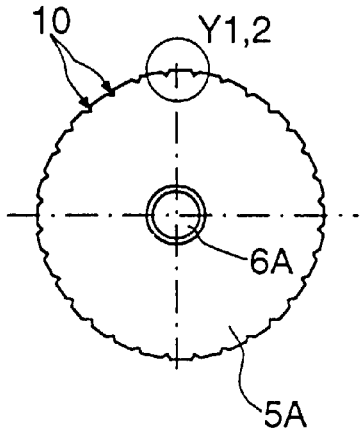
Figure 2B:
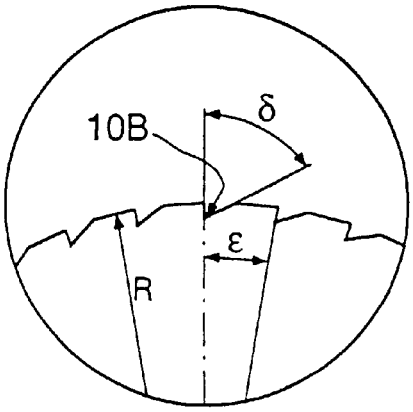
Figure 2B:
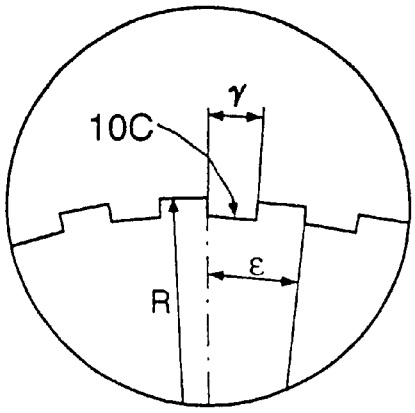

As shown in the plan view of FIGS. 1B and 2B, axial grooves 10 may also be provided on the circumference of the cylinder 5 and 5A, respectively. The minimum number is one or two axial grooves per cylinder circumference. Shown are configurations with $\phi=10°$, which corresponds to 36 grooves 10 in FIG. 1BY or $\epsilon=8°$, which corresponds to 45 grooves 10 in FIGS. 2BY1 and 2BY2. The groove forms are as follows: V form in the case of grooves 10A with an angle $\alpha$ of about 112°, sawtooth form in the case of grooves 10B with an angle $\delta$ of about 63° and rectangular form in the case of grooves 10C with an angle $\gamma$ of about 3.6°. Other groove forms are also suitable for the purposes of the invention, to detach and pick up abrasively shed material from the coated tape. The grooves 10 are produced by sawing, milling, grinding or else by spark erosion methods or EDM (Electrical Discharge Milling) methods.

Apart from hardened steel (hardness about 60 Rockwell), suitable materials for the cylinder circumference are also oxide ceramic or hard metall alloys, for instance based on titanium carbide, tungsten carbide etc., in particular if the coating of the coated tape contains hard particles.

By means of the polishing element, the surface of the coated tape is heated so intensely in a thickness range of just a few molecule layers that the roughness peaks are melted away and, in a pasty state, are smeared into the valleys, the surface becoming smooth and glossy. This melted layer is known as a "Beilby layer". It is important here that the polishing does not remove any material, either in the form of chips or other particles, or in any other form. In this way, surprisingly, any occurrence and depostition of abrasively shed material, with its disadvantages mentioned above, can be deliberately avoided.

To obtain good polishing results, it has been found that a relative speed between the cylinder circumference and the coated tape in the range from −10 to +10 m/s is advantageous, the negative sign indicating a slower circumferential speed than the speed of the coated tape, the positive sign indicating a faster speed.

Depending on the material of the coated tape, the contact angle between tape and cylinder circumference and the tape tension during the movement can be optimized.

It has been possible by means of the apparatus to the invention to reduce the abrasive shedding of coated tapes by a factor of 10, with low expenditure on the apparatus, production and maintenance.

We claim:

1. A method of reducing the roughness and abrasive shedding of coated tapes by generating heat upon the surface of the tape by polishing it with a rotating polishing element having a circumferential surface with substantially coaxial grooves, and wherein the coaxial grooves have a minimum pitch of 0.16 mm.

2. The method of claim 1, wherein the coated tape has a width and the polishing element is a cylinder having a height greater than or approximately equal to the width of the coated tape.

3. The method of claim 1, wherein the surface also has axial grooves.

4. The method of claim 3, wherein the axial grooves have a V form.

5. The method of claim 3, wherein the axial grooves have a sawtooth form.

6. The method of claim 1, wherein the number of coaxial grooves is about 1 to 20.

7. The method of claim 1, wherein the coaxial grooves have a substantially V form and the distance at the circumferential surface of the cylinder between the coaxial grooves is about 0.1 mm.

8. The method of claim 1, wherein the material of the circumferential surface comprises hardened steel.

9. The method of claim 1, wherein the material of the circumferential surface comprises oxide ceramic.

10. The method of claim 1, wherein the material of the circumferential surface comprises a hard metal alloy.

11. The method of claim 1, wherein the material of the circumferential surface has a hardness of at least 60 Rockwell.

12. The method of claim 2, wherein the height of the cylinder is about twice the width of the-coated tape.

13. The method of claim 4, wherein the axial grooves have a V form which encloses an angle ($\alpha$) of about 112°.

14. The method of claim 5, wherein the axial grooves have a sawtooth from which encloses an angle ($\delta$) of about 63°.

15. The method of claim 6, wherein the number of coaxial grooves is about 10.

16. The method of claim 2, wherein the surface also has axial grooves.

17. The method of claim 16, wherein the coaxial grooves have a substantially V form and the flank width of the ridges at the circumferential surface of the cylinder between the coaxial grooves is about 0.1 mm.

18. The method of claim 1, wherein the surface of the coated tape is heated so intensely in a thickness range of just a few molecule layers that roughness peaks are melted away and are smeared into valleys, the surface becoming smooth and glossy.

19. The method of claim 1, wherein the polishing does not remove any material, in the form of chips or other particles, from the coated tape.

20. The method of claim 1, wherein the relative speed during the polishing between the circumferential surface of the polishing element and the coated tape is from −10 to +10 m/s.

* * * * *